US011479896B2

(12) United States Patent
Kim et al.

(10) Patent No.: US 11,479,896 B2
(45) Date of Patent: Oct. 25, 2022

(54) APPARATUS AND METHOD FOR TREATING GARMENTS

(71) Applicant: SAMSUNG ELECTRONICS CO., LTD., Suwon-si (KR)

(72) Inventors: Jeongin Kim, Suwon-si (KR); Seongho Byeon, Suwon-si (KR); Sangwon Ahn, Suwon-si (KR); Seongil Hahm, Suwon-si (KR); Jaesick Shin, Suwon-si (KR); Hyunjin Yi, Suwon-si (KR); Junsik Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 352 days.

(21) Appl. No.: 16/791,526

(22) Filed: Feb. 14, 2020

(65) Prior Publication Data

US 2020/0263339 A1 Aug. 20, 2020

(30) Foreign Application Priority Data

Feb. 15, 2019 (KR) ..... 10-2019-0017962

(51) Int. Cl.
*D06F 34/05* (2020.01)
*D06F 33/52* (2020.01)
(Continued)

(52) U.S. Cl.
CPC ..... *D06F 34/05* (2020.02); *D06F 33/32* (2020.02); *D06F 33/52* (2020.02); *D06F 33/60* (2020.02);
(Continued)

(58) Field of Classification Search
CPC ..... D06F 33/60; D06F 33/70; D06F 35/006; D06F 2105/48; D06F 39/024; D06F 34/05; D06F 33/52; D06F 33/32
See application file for complete search history.

(56) References Cited

U.S. PATENT DOCUMENTS 6,958,693 B2 10/2005 Rothgeb et al.
2011/0315709 A1* 12/2011 Fileccia ..... D06F 33/37 222/1
(Continued)

FOREIGN PATENT DOCUMENTS

JP 2010-284288 A 12/2010
JP 2018143646 A 9/2018
(Continued)

OTHER PUBLICATIONS

Machine translation of JP2018143646A, dated Sep. 2018. (Year: 2018).*
Machine translation of KR101939089B1, dated Jan. 2019. (Year: 2019).*
International Search Report (PCT/ISA/210) and Written Opinion (PCT/ISA/237) dated May 26, 2020 issued by the International Searching Authority in International Application No. PCT/KR2020/002168.

*Primary Examiner* — Joseph L. Perrin
*Assistant Examiner* — Kevin G Lee
(74) *Attorney, Agent, or Firm* — Sughrue Mion, PLLC

(57) ABSTRACT

An apparatus and a method for treating garments are provided. A method, performed by a garment treatment apparatus, of controlling an operation of the garment treatment apparatus includes: establishing wireless communication with a monitoring device placed inside a drum of the garment treatment apparatus; rotating the drum; receiving movement information associated with movement of the monitoring device from the monitoring device during the rotation of the drum; and controlling the rotation of the drum based on the received movement information.

18 Claims, 13 Drawing Sheets

(51) Int. Cl.

| | |
|---|---|
| ***D06F 33/32*** | (2020.01) |
| *D06F 33/60* | (2020.01) |
| *D06F 33/70* | (2020.01) |
| *D06F 103/08* | (2020.01) |
| *D06F 105/48* | (2020.01) |
| *D06F 105/56* | (2020.01) |
| *D06F 103/24* | (2020.01) |
| *D06F 39/02* | (2006.01) |

(52) U.S. Cl.
CPC ..... *D06F 33/70* (2020.02); *D06F 39/024* (2013.01); *D06F 2103/08* (2020.02); *D06F 2103/24* (2020.02); *D06F 2105/48* (2020.02); *D06F 2105/56* (2020.02)

(56) References Cited

U.S. PATENT DOCUMENTS

| | | | | |
|---|---|---|---|---|
| 2014/0115792 | A1* | 5/2014 | Lee ..... | D06F 33/32 68/12.06 |
| 2018/0245269 | A1 | 8/2018 | Bing et al. | |

FOREIGN PATENT DOCUMENTS

| | | | |
|---|---|---|---|
| KR | 1020060088720 | A | 8/2006 |
| KR | 10-2010-0026346 | A | 3/2010 |
| KR | 10-2016-0039872 | A | 4/2016 |
| KR | 101939089 | B1 | 1/2019 |
| KR | 10-1957166 | B1 | 7/2019 |
| WO | 2017167658 | A1 | 10/2017 |

* cited by examiner

APPARATUS AND METHOD FOR TREATING GARMENTS

CROSS-REFERENCE TO RELATED APPLICATION

This application is based on and claims priority under 35 U.S.C. § 119 to Korean Patent Application No. 10-2019-0017962, filed on Feb. 15, 2019, in the Korean Intellectual Property Office, the disclosure of which is incorporated by reference herein in its entirety.

BACKGROUND

1. Field

The disclosure relates to an apparatus and method for treating garments, and more particularly, to an apparatus and a method for treating garments by communicating with a monitoring device.

2. Description of Related Art

In general, garment treatment apparatuses are home appliances for treating garments and may include a washer, a dryer, and the like. The garment treatment apparatuses may be classified into apparatuses having a drum standing in a vertical direction and apparatuses having a drum lying in a horizontal direction. The garment treatment apparatuses need to effectively treat garments by controlling a strength and a treatment time for treating the garments while rotating a drum accommodating the garments therein.

Accordingly, there is demand for a technique capable of effectively treating the garments in the drum by more accurately monitoring a state of the garments in the drum while treating the garments.

SUMMARY

According to an embodiment of the disclosure, provided are an apparatus and method for treating garments by using movement information of a monitoring device moving in a drum together with the garments.

According to an embodiment of the disclosure, provided are a garment treatment apparatus and method capable of adjusting a motion of a drum by using movement information of a monitoring device moving in the drum together with garments.

According to an embodiment of the disclosure, provided are a garment treatment apparatus and method capable of adjusting a garment treatment time by using movement information of a monitoring device moving in the drum together with garments.

According to an embodiment of the disclosure, provided are a garment treatment apparatus and method capable of disentangling garments by using movement information of a monitoring device moving in the drum together with the garments.

Additional aspects will be set forth in part in the description which follows and, in part, will be apparent from the description, or may be learned by practice of the presented embodiments of the disclosure.

According to an aspect of the disclosure, a method, performed by a garment treatment apparatus, of controlling an operation of the garment treatment apparatus includes: establishing wireless communication with a monitoring device placed inside a drum of the garment treatment apparatus; rotating the drum to treat garments; receiving movement information associated with movement of the monitoring device from the monitoring device during the rotating of the drum; and controlling the rotating of the drum based on the movement information received, wherein the monitoring device moves in the drum, that is rotating, together with the garments in the garment treatment apparatus.

According to another aspect of the disclosure, a garment treatment apparatus includes: a communication interface configured to wirelessly communicate with a monitoring device; a drum configured to accommodate garments and the monitoring device therein; a memory storing one or more instructions; and a controller configured to execute the one or more instructions stored in the memory, wherein the controller is further configured, by executing the one or more instructions, to establish wireless communication with the monitoring device placed inside the drum, rotate the drum to treat the garments, receive movement information associated with movement of the monitoring device from the monitoring device during the rotating of the drum, and control the rotating of the drum based on the movement information received, wherein, in a case where the drum is rotating, the monitoring device moves in the drum together with the garments in the garment treatment apparatus.

According to another aspect of the disclosure, a monitoring device configured to be placed inside a garment treatment apparatus includes: a communication interface configured to wirelessly communicate with the garment treatment apparatus; a sensor; a memory storing one or more instructions; and a processor configured to execute the one or more instructions stored in the memory, wherein the processor is further configured, by executing the one or more instructions, to form wireless communication with the garment treatment apparatus, sense movement of the monitoring device caused by rotation of a drum of the garment treatment apparatus during the rotation, of the drum, and provide sensing data associated with the movement of the monitoring device to the garment treatment apparatus, wherein, in a case where the drum is rotating, the monitoring device moves in the drum together with garments in the garment treatment apparatus, and the sensing data that is provided, is used by the garment treatment apparatus to control the rotation of the drum to treat the garments.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
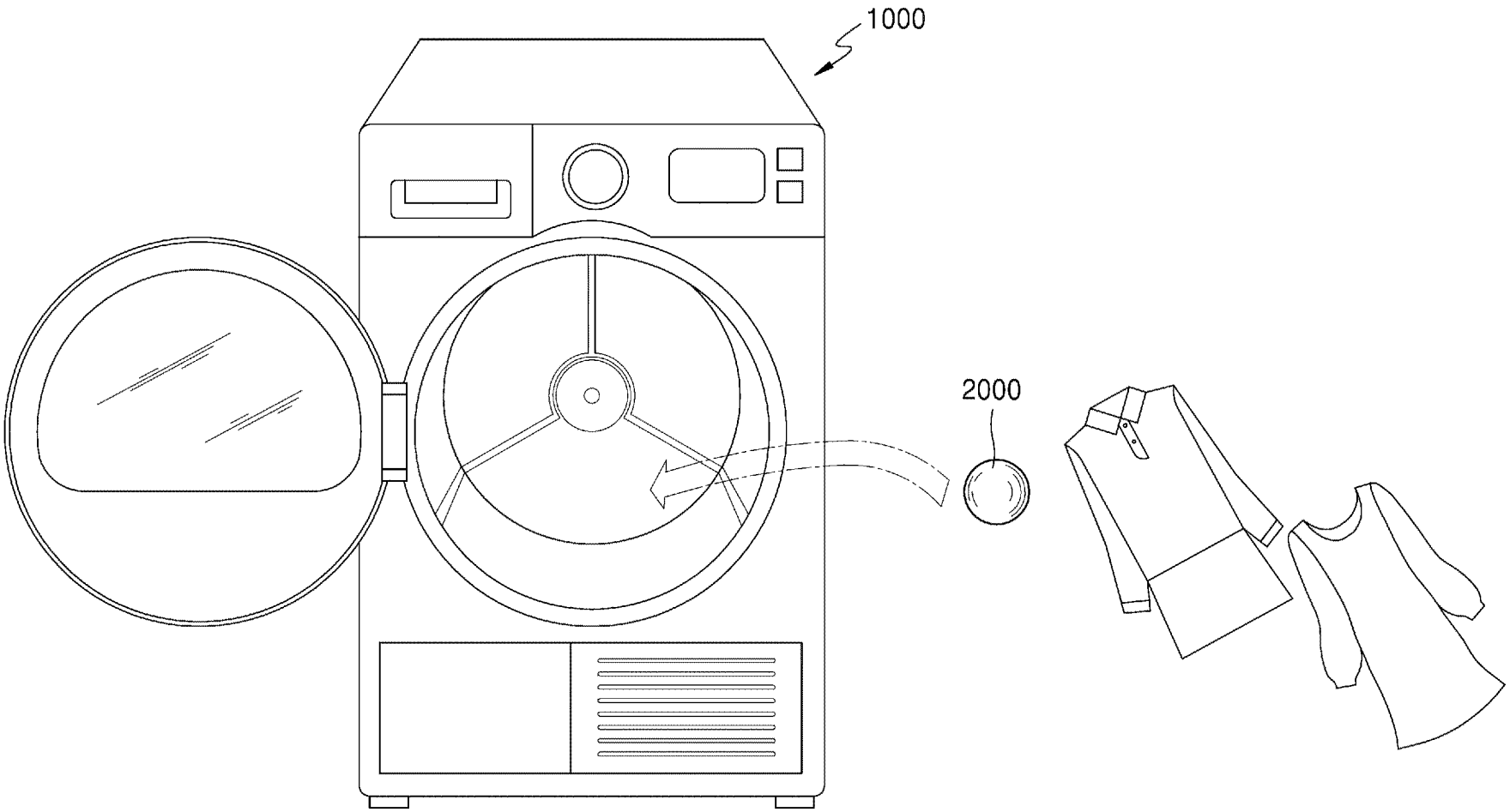
FIG. 1 illustrates an example in which a garment treatment apparatus treats garments by using a monitoring device, according to an embodiment of the disclosure.

Hereinafter, embodiments of the disclosure will be described in detail with reference to the accompanying drawings so that those of ordinary skill in the art may easily realize the disclosure. However, the disclosure may be embodied in many different forms and should not be construed as being limited to the embodiments set forth herein. In addition, in the drawings, parts irrelevant to the description are omitted to clearly describe the disclosure and like reference numerals denote like elements throughout the specification.

Throughout the disclosure, the expression "at least one of a, b or c" indicates only a, only b, only c, both a and b, both a and c, both b and c, all of a, b, and c, or variations thereof.

Throughout the specification, when it is described that a certain part is "connected" to another part, it should be and understood that the certain part may be "directly connected" or "electrically connected" to another part via another element in the middle. In addition, when a certain part "includes" a certain component, this indicates that the part may further include another component instead of excluding another component unless there is different disclosure.

Hereinafter, the disclosure will be described in detail with reference to the accompanying drawings.

FIG. 1 illustrates an example in which a garment treatment apparatus 1000 treats garments by using a monitoring device 2000, according to an embodiment of the disclosure.

Referring to FIG. 1, the garment treatment apparatus 1000 is an apparatus for treating garments and may perform a function of treating garments placed inside the garment treatment apparatus 1000. The garment treatment apparatus 1000 may be, for example, a home appliance such as a washer or a dryer and may include a rotatable drum. In addition, the garment treatment apparatus 1000 may treat garments by executing functions, e.g., drying, washing, rinsing, dehydrating, and the like.

The monitoring device 2000 is a device placed inside the garment treatment apparatus 1000 together with garments and may move inside the drum together with the garments according to rotation of the drum. The monitoring device 2000 may be connected, via communication to the garment treatment apparatus 1000 and transmit movement information associated with movement of the monitoring device 2000 to the garment treatment apparatus 1000 in the middle of treating garments by the garment treatment apparatus 1000. The monitoring device 2000 may have a shape close to a spherical shape, e.g., a ball-like shape.

In addition, the garment treatment apparatus 1000 may execute or change an operation for treating garments according to preset criteria based on movement information of the monitoring device 2000 moving together with garments inside the drum.

Figure 2:
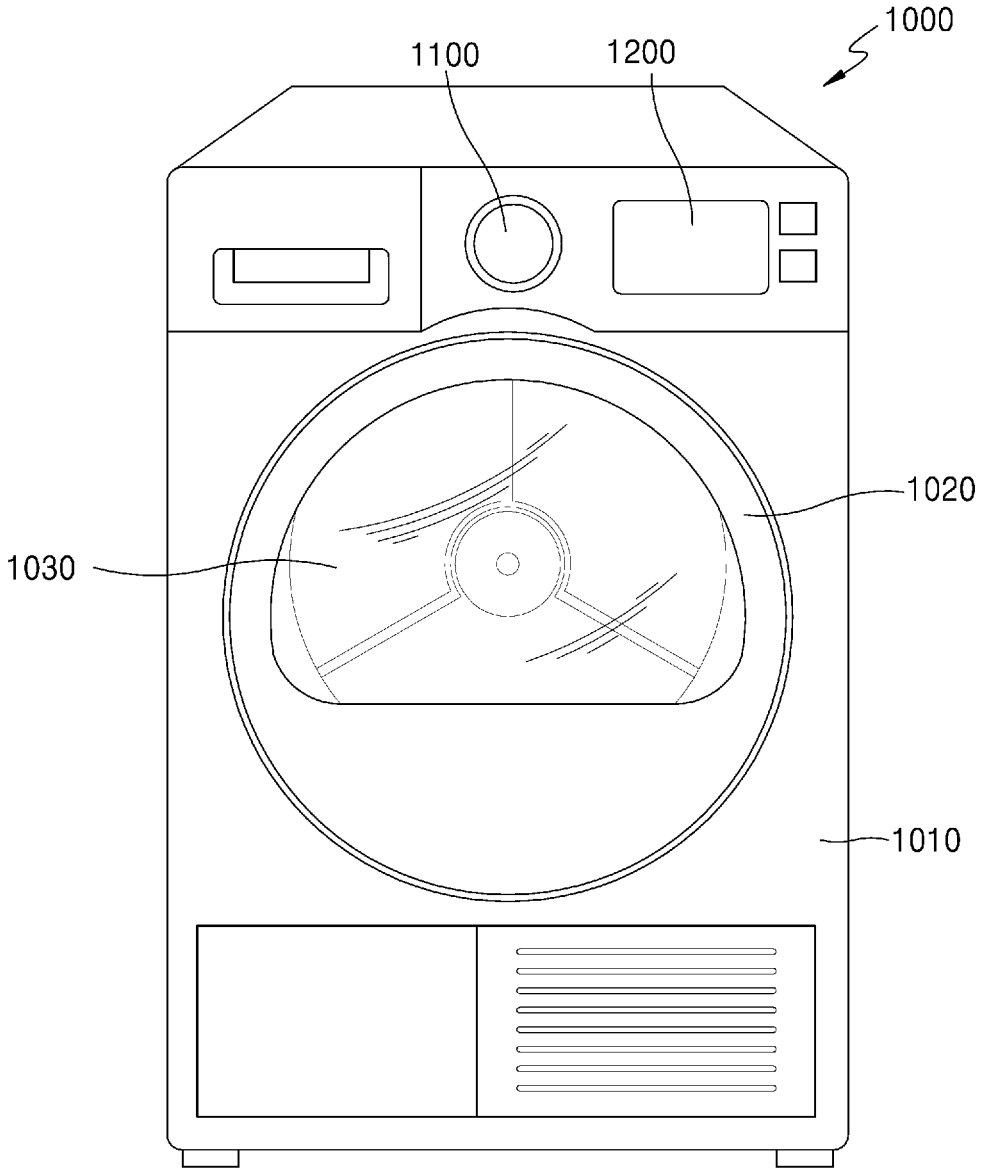
FIG. 2 is a front view of the garment treatment apparatus according to an embodiment of the disclosure.
Figure 3:
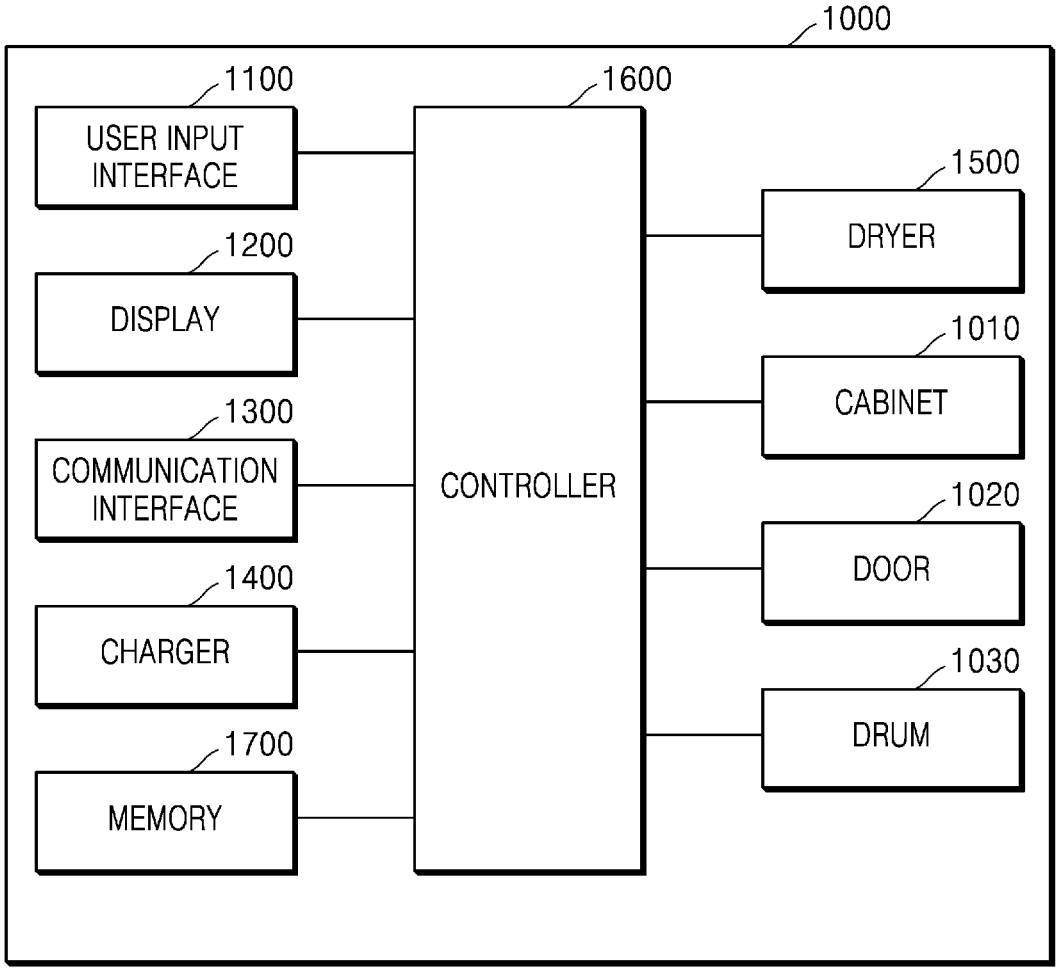
FIG. 3 is a block diagram of the garment treatment apparatus according to an embodiment of the disclosure.

FIG. 2 is a front view of the garment treatment apparatus 1000 according to an embodiment of the disclosure and FIG. 3 is a block diagram of the garment treatment apparatus 1000 according to an embodiment of the disclosure.

Referring to FIGS. 2 and 3, the garment treatment apparatus 1000 according to an embodiment of the disclosure may include a cabinet 1010, a door 1020, a drum 1030, a user input interface 1100, a display 1200, a communication interface 1300, a charger 1400, a dryer 1500, a controller 1600, and a memory 1700.

The cabinet 1010 may be a housing establishing an exterior of the garment treatment apparatus 1000, and the door 1020 provided to one side of the cabinet 1010 may open or close an opening at the one side of the cabinet 1010. When the door 1020 provided to the one side of the cabinet 1010 is opened, external garments and the monitoring device 2000 may be placed inside the drum 1030 through the opening of the cabinet 1010. The drum 1030 may be rotatably provided to the inside of the cabinet 1010, and rotation of the drum 1030 may cause the garments and the monitoring device 2000 inside the drum 1030 to move.

The user input interface 1100 may be a means through which a user inputs data for controlling the garment treatment apparatus 1000. For example, the user input interface 1100 may include a keypad, a dome switch, a touch pad (a capacitive overlay touch pad, a resistive overlay touch pad, an infrared (IR) beam touch pad, a surface acoustic wave touch pad, an integral strain gauge touch pad, a piezoelectric touch pad, or the like), a jog wheel, a jog switch, and the like but is not limited thereto.

The user input interface 1100 may receive the user's input to control the garment treatment apparatus 1000. The user input interface 1100 may have a rotatable knob shape, and the user may apply power to the garment treatment apparatus 1000 through the user input interface 1100. In addition, the user may rotate the user input interface 1100 to select a garment treatment course and to operate the garment treatment apparatus 1000. The garment treatment course ay include, for example, standard drying, rapid drying, bedclothes dusting, washing, rinsing, dehydrating, and the like but is not limited thereto. In addition, the user may also set a drying strength, a rotating speed of the drum 1030, a drying time, and the like through the user input interface 1100.

The display 1200 may display information processed by the garment treatment apparatus 1000. For example, the display 1200 may display a user interface (UI) for controlling the garment treatment apparatus 1000, information associated with a garment treatment course, and a garment treatment state. When the display 1200 and a touch pad form a layer structure to configure a touchscreen, the display 1200 may be used as not only an output device but also an input device. The display 1200 may include at least one of a liquid crystal display, a thin-film transistor liquid crystal display, an organic light-emitting diode display, a flexible display, a three-dimensional (3D) display, or an electrophoretic display.

The communication interface 1300 may include one or more components for communicating with the monitoring device 2000, a mobile device (not shown), and a server (not shown). For example, the communication interface 1300 may include a short-range wireless communication interface and a mobile communication interface. The short-range wireless communication interface may include a Bluetooth communication interface, a Bluetooth low energy (BLE) communication interface, a near field communication (NFC) interface, a Wi-Fi communication interface, a Zigbee communication interface, an infrared data association (IrDA) communication interface, a Wi-Fi Direct (WFD) communication interface, an ultra-wideband (UWB) communication interface, an Ant+ communication interface, and the like but is not limited thereto. The mobile communication interface may transmit and receive a wireless signal to and from at least one of a base station, an external terminal, or a server in a mobile communication network.

The charger 1400 may charge the monitoring device 2000. The charger 1400 may charge the monitoring device 2000 seated on a charging groove inside the drum 1030, in a wireless or wired manner. When the charger 1400 charges the monitoring device 2000 in a wired manner, the charger 1400 may charge the monitoring device 2000 through a charging terminal in the charging groove inside the drum 1030 or a charging terminal of the monitoring device 2000.

The dryer 1500 may dry garments. The dryer 1500 may provide hot wind to the inside of the drum 1030 under control of the controller 1600. The dryer 1500 may remove humidity inside the drum 1030 through a certain dehumidification function under control of the controller 1600.

The memory 1700 may store a program for controlling the garment treatment apparatus 1000 and store data input to the garment treatment apparatus 1000 or data to be output from the garment treatment apparatus 1000. The memory 1700 may include at least one type of storage medium among a flash memory type memory, a hard disk type memory, a multimedia card micro type memory, a card type memory (e.g., a secure digital (SD) or extreme digital (XD) memory), random access memory (RAM), static RAM (SRAM), read only memory (ROM) electrically erasable programmable ROM (EEPROM), PROM, a magnetic memory, a magnetic disc, and an optical disc. Programs stored in the memory 1700 may be classified into a plurality of modules according to functions thereof, e.g., a UI module, a touchscreen module, and the like.

The controller 1600 controls a general operation of the garment treatment apparatus 1000. For example, the controller 1600 may generally control the door 1020, the drum 1030, the user input interface 1100, the display 1200, the communication interface 1300, the charger 1400, the dryer 1500, and the memory 1700 by executing the programs stored in the memory 1700. The controller 1600 may control operations of the garment treatment apparatus 1000, which are disclosed in the specification, by controlling the door 1020, the drum 1030, the user input interface 1100, the display 1200, the communication interface 1300, the charger 1400, the dryer 1500, and the memory 1700.

The controller 1600 may receive movement information associated with movement of the monitoring device 2000 from the monitoring device 4000 placed inside the drum 1030. When the controller 1600 executes an operation for treating garments, the drum 1030 of the garment treatment apparatus 1000 may rotate. In addition, according to the rotation of the drum 1030, the garments and the monitoring device 2000 inside the drum 1030 may move. The monitoring device 2000 may acquire movement information indicating a moving direction, a moving speed, an acceleration, and an acceleration change of the monitoring device 2000 by using a sensor inside monitoring device 2000. In addition the monitoring device 2000 may transmit the acquired movement information to the garment treatment apparatus 1000 in real-time. The controller 1600 may control the rotation of the drum 1030 based on the received movement information. The controller 1600 may change a rotating speed of the drum 1030, a speed of a motor for rotating the drum 1030, a rotating direction of the drum 1030, and a rotating pattern of the drum 1030 based on the movement information received from the monitoring device 2000.

When an operation for garment treatment starts, the controller 1600 may repeat an operation of rotating and suspending the drum 1030 for a certain time to estimate an amount of garments inside the drum 1030. In addition, the controller 1600 may control the rotation of the drum 1030 by considering both the estimated amount of the garments and the movement information received from the monitoring device 2000.

The controller 1600 may change the rotating speed of the drum 1030. The controller 1600 may estimate an amount of garments inside the drum 1030 at the beginning of a dry function and determine the rotating speed and the rotating direction of the drum 1030 based on the estimated amount of the garments In addition the controller 1600 may estimate a rotating speed and a rotating direction of the garments according to the determined rotating speed and rotating direction of the drum 1030. In addition, in the middle of the rotation of the drum 1030, the controller 1600 may change at least one of the rotating speed or the rotating direction of the drum 1030 based on a moving speed and a moving direction received from the monitoring device 2000. When the moving speed of the monitoring device 2000 differs from the estimated moving speed of the garments, the controller 1600 may change the rotating speed of the drum 1030.

The controller 1600 may change a drying time. The controller 1600 may estimate an amount of garments inside the drum 1030 at the beginning of the dry function and determine a drying time for which a drying operation is executed, based on the estimated amount of the garments. In addition, the controller 1600 may estimate an acceleration of the garments based on the estimated amount of the garments and the rotating speed of the drum 1030. The garments may drop from a high position to a low position inside the drum 1030 while moving inside the drum 1030 in a clockwise or counterclockwise direction. In addition, in the middle of the rotation of the drum 1030, the controller 1600 may change the drying time of the garment treatment apparatus 1000 based on the acceleration of the monitoring device 2000, which is received from the monitoring device 2000. When the acceleration of the monitoring device 2000 differs from the estimated acceleration of the garments, the controller 1600 may change the drying time.

The controller 1600 may identify a change in the acceleration of the monitoring device 2000. The controller 1600 may cumulatively store acceleration data of the monitoring device 2000, which is received from the monitoring device 2000, and compare the cumulatively stored acceleration data.

The controller 1600 may analyze a movement history of the monitoring device 2000. The controller 1600 may analyze a movement history about movement of the monitoring device 2000 during execution of the dry function of the garment treatment apparatus 1000 based on a history of moving directions and moving speeds of the monitoring device 2000.

The controller 1600 may determine the rotating pattern of the drum 1030. The controller 1600 may estimate how the garments inside the drum 1030 have been entangled, based on history information about the moving directions and the moving speeds of the monitoring device 2000. The controller 1600 may determine a rotating pattern of the drum 1030 for disentangling the entangled garments inside the drum 1030, based on the history information about the moving directions and the moving speeds of the monitoring device 2000. The controller 1600 may determine the rotating pattern of the drum 1030 by using a certain learning model for determining the rotating pattern of the drum 1030 to disentangle the entangled garments. The certain learning model for determining the rotating pattern of the drum 1030 to disentangle the entangled garments may be a learning model trained using an artificial intelligence algorithm that is at least one of, for example, a machine learning algorithm, a neural network algorithm, a genetic algorithm, a deep learning algorithm, or a classification algorithm.

The controller 1600 may execute an operation for disentangling the garments. The controller 1600 may control the rotation of the drum 1030 inside the garment treatment apparatus 1000 according to the acquired rotating pattern of the drum 1030.

The controller 1600 may change the drying time of the garment treatment apparatus 1000 based on humidity information received from the monitoring device 2000. The controller 1600 may change the drying time for which a drying operation is executed, by considering both humidity measured by a humidity sensor of the garment treatment apparatus 1000 and humidity measured by the monitoring device 2000 in the middle of the execution of the drying operation.

Figure 4:
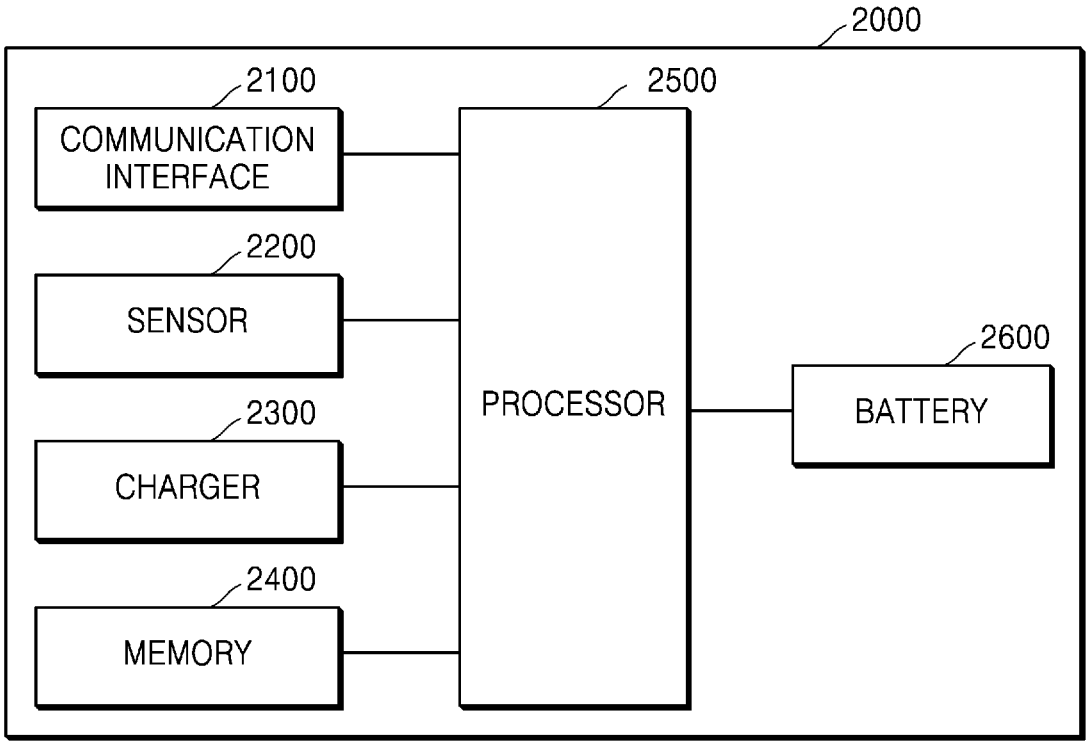
FIG. 4 is a block diagram of the monitoring device according to an embodiment of the disclosure.
Figure 5:
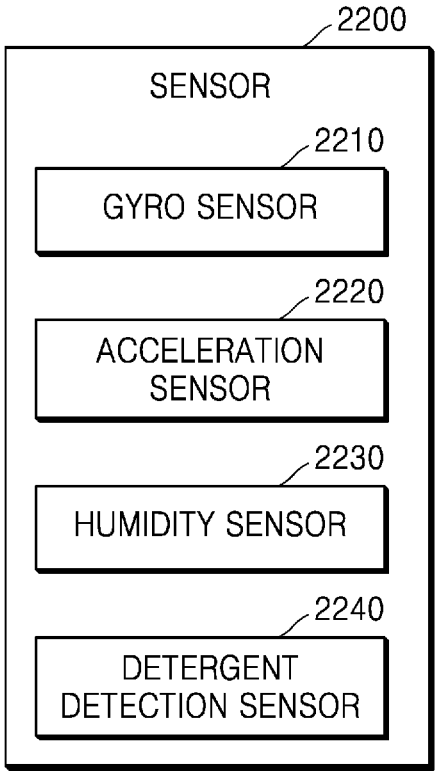
FIG. 5 is a block diagram of a sensor according to an embodiment of the disclosure.

FIG. 4 is a block diagram of the monitoring device 2000 according to an embodiment of the disclosure, and FIG. 5 is a block diagram of a sensor 2200 according to an embodiment of the disclosure.

Referring to FIG. 4, the monitoring device 2000 may include a communication interface 2100, the sensor 2200, a charger 2300, a memory 2400, a processor 2500, and a battery 2600.

The communication interface 2100 may include one or more components for communicating with the garment treatment apparatus 1000 and a mobile device (not shown). For example, the communication interface 2100 may include a short-range wireless communication interface. The short-range wireless communication interface may include a Bluetooth communication interface, a BLE communication interface an NFC interface, a Wi-Fi communication interface, a Zigbee communication interface an IrDA communication interface, a WFD communication interface, a UWB communication interface, an Ant+ communication interface, and the like but is not limited thereto.

The sensor 2200 may sense a state of the monitoring device 2000 or an ambient state of the monitoring device 2000. The sensor 2200 may include a gyro sensor 2210, an acceleration sensor 2220, a humidity sensor 2230, and a detergent detection sensor 2240. In addition, the sensor 2200 may include, for example, a geomagnetic sensor, a temperature sensor, and the like but is not limited thereto. In addition, the detergent detection sensor 2240 may include, for example, an olfactory sensor and a spectral measurement sensor but is not limited thereto. A function of each sensor may be intuitively inferred by those of ordinary skill in the art from a name thereof, and thus a detailed description thereof is omitted herein.

In addition, the monitoring device 2000 may have a spherical shape, and the sensor 2200 may be embedded in the monitoring device 2000. Some sensors included in the sensor 2200 may be located at a central part of the monitoring device 2000, and the other sensors included in the sensor 2200 may be exposed to the outside. For example, the geomagnetic sensor, acceleration sensor 2220, and the gyro sensor 2210 may be provided at the central part of the monitoring device 2000, and the temperature sensor and the humidity sensor 2230 may be provided to an outer circumferential part so as to be exposed to the outside.

The charger 2300 may charge the battery 2600. The charger 2300 may charge the battery 2600 in a wired or wireless manner based on a current provided from the garment treatment apparatus 1000.

The memory 2400 may store a program for controlling the monitoring device 2000 and store data acquired by the monitoring device 2000 or data to be output from the monitoring device 2000. The memory 2400 may include at least one type of storage medium among a flash memory type memory, a multimedia card micro type memory, a card type memory (e.g., an SD or XD memory), RAM, SRAM, ROM, EEPROM, and PROM.

The processor 2500 controls a general operation of the monitoring device 2000. For example, the processor 2500 may generally control the communication interlace 2100, the sensor 2200, the charger 2300, the memory 2400, and the battery 2600 by executing programs stored in, the memory 2400. The processor 2500 may control operations of the monitoring device 2000, which are disclosed in the specification, by generally controlling the communication interface 2100, the sensor 2200, the charger 2300 the memory 2400, and the battery 2600.

The processor 2500 may be connected, via communication, to the garment treatment apparatus 1000. The processor 2500 may be connected, via communication, to the garment treatment apparatus 1000 through Bluetooth communication or Wi-Fi communication.

The garment treatment apparatus 1000 may transmit, to the monitoring device 2000, a signal indicating initiation of a monitoring operation of the monitoring device 2000, and the processor 2500 may activate a function of monitoring a state of the inside of the drum 1030 in response to an activation command of the garment treatment apparatus 1000.

The processor 2500 may measure a moving direction of the monitoring device 2000. According to rotation of the drum 1030 in the garment treatment apparatus 1000 in the clockwise or counterclockwise direction, the monitoring device 2000 may move in the clockwise or counterclockwise direction together with garments. In addition, the processor 2500 may monitor movement of the monitoring device 2000 by using the sensor 2200 and acquire sensing data about a moving direction of the monitoring device 2000. The processor 2500 may acquire the sensing data about the moving direction of the monitoring device 2000 by using, for example, a motion sensor and the gyro sensor 2210. The processor 2500 may periodically measure a moving direction of the monitoring device 2000 in a certain period. The processor 2500 may measure moving directions of the monitoring device 2000 for a certain time range. The processor 2500 may measure a moving speed of the monitoring device 2000. In addition, the processor 2500 may monitor movement of the monitoring device 2000 by using the sensor 2200 and acquire sensing data about a moving speed of the monitoring device 2000. The processor 2500 may acquire the sensing data about the moving speed of the monitoring device 2000 by using, for example, the motion sensor and the gyro sensor 2210. The processor 2500 may periodically measure a moving speed of the monitoring device 2000 in a certain period. The processor 2500 may measure moving speeds of the monitoring device 2000 for a certain time range. The processor 2500 may transmit information about a moving direction and a moving speed to the garment treatment apparatus 1000. The processor 2500 may transmit real-time sensing data about a moving direction and a moving speed to the garment treatment apparatus 1000.

The processor 2500 may measure an acceleration of the monitoring device 2000. The processor 2500 may measure an acceleration of the monitoring device 2000 by using the acceleration sensor 2220 and acquire sensing data indicating the acceleration of the monitoring device 2000. The processor 2500 may periodically measure an acceleration of the monitoring device 2000 in a certain period. The processor 2500 may measure accelerations of the monitoring device 2000 for a certain time range. The processor 2500 may transmit information about an acceleration to the garment treatment apparatus 1000. The processor 2500 may transmit real-time sensing data about an acceleration of the monitoring device 2000 to the garment treatment apparatus 1000.

The processor 2500 may measure ambient humidity of the monitoring device 2000. The processor 2500 may measure ambient humidity of the monitoring device 2000 by using the humidity sensor 2230 and acquire sensing data indicating the ambient humidity of the monitoring device 2000. The processor 2500 may periodically measure ambient humidity of the monitoring device 2000 in a certain period. The processor 2500 may transmit information about humidity to the garment treatment apparatus 1000. The processor 2500 may transmit real-time sensing data about ambient humidity of the monitoring device 2000 to the garment treatment apparatus 1000.

Figure 6:
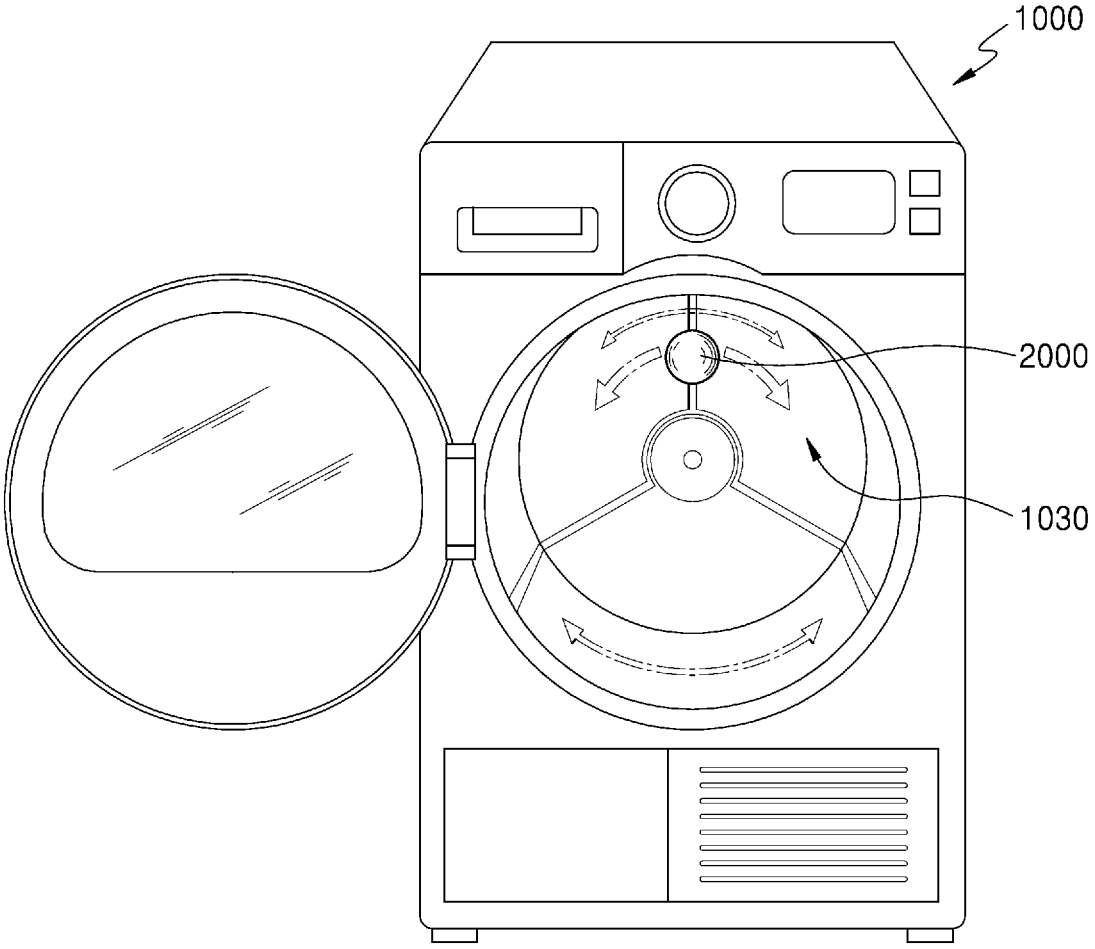
FIG. 6 illustrates n example in which the monitoring device moves in the garment treatment apparatus, according to an embodiment of the disclosure.

FIG. 6 illustrates an example in which the monitoring device 2000 moves in the garment treatment apparatus 1000, according to an embodiment of the disclosure.

Referring to FIG. 6, the drum 1030 of the garment treatment apparatus 1000 may rotate in the clockwise or counterclockwise direction. According to the rotation of the drum 1030, the monitoring device 2000 placed inside the drum 1030 may move in the clockwise or counterclockwise direction. The monitoring device 2000 may be manufactured in, for example, a spherical shape and move inside the drum 1030 together with garments placed inside the drum 1030. Movement of the monitoring device 2000 inside the drum 1030 may vary depending on a rotating speed of the drum 1030, an amount of garments inside the drum 1030, and entanglement of the garments inside the drum 1030. The monitoring device 2000 may transmit movement information associated with the movement of the monitoring device 2000 to the garment treatment apparatus 1000.

Figure 7:
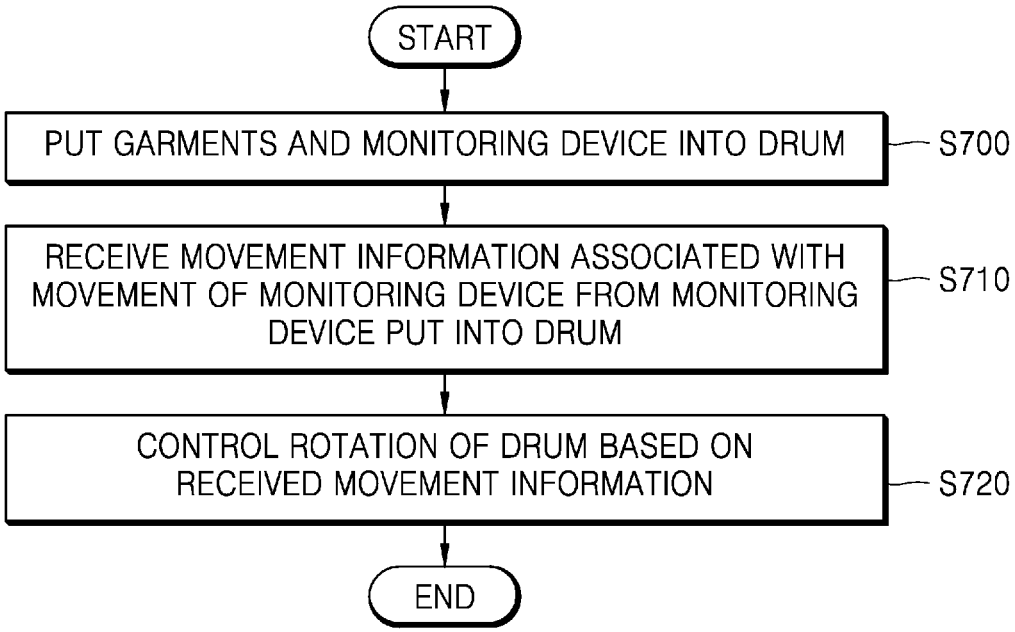
FIG. 7 is a flowchart of a method, performed by the garment treatment apparatus, of controlling an operation of the garment treatment apparatus by interworking with the monitoring device, according to an embodiment of the disclosure.

FIG. 7 is a flowchart of a method, performed by the garment treatment apparatus 1000, of controlling an operation of the garment treatment apparatus 1000 by inter working with the monitoring device 2000, according to an embodiment of the disclosure.

In operation S700, garments and the monitoring device 2000 may be placed inside the drum 1030. The garments and the monitoring device 2000 may be placed inside the drum 1030 by a user before the garment treatment apparatus 1000 executes an operation for garment treatment.

In operation S710 the garment treatment apparatus 1000 may receive movement information associated with movement of the monitoring device 2000 from the monitoring device 2000 placed inside the drum 1030. When the garment treatment apparatus 1000 executes an operation for garment treatment, the drum 1030 of the garment treatment apparatus 1000 may rotate. In addition, according to the rotation of the drum 1030, the garments and the monitoring device 2000 inside the drum 1030 may move. The monitoring device 2000 may acquire movement information indicating a moving direction, a moving speed, an acceleration, an acceleration change, and the like of the monitoring device 2000 by using a sensor inside the monitoring device 2000. In addition, the monitoring device 2000 may transmit the acquired movement information to the garment treatment apparatus 1000 in real-time.

In operation S720, the garment treatment apparatus 1000 may control the rotation of the drum 1030 based on the received movement information. The garment treatment apparatus 1000 may change a rotating speed of the drum 1030, a speed of a motor for rotating the drum 1030, a rotating direction of the drum 1030, and a rotating pattern of the drum 1030 based on the movement information received from the monitoring device 2000.

When the operation for garment treatment starts, the garment treatment apparatus 1000 may repeat an operation of rotating and suspending the drum 1030 for a certain time to estimate an amount of the garments inside the drum 1030. In addition, the garment treatment apparatus 1000 may control rotation of the drum 1030 by considering both the estimated amount of the garments and the movement information received from the monitoring device 2000.

Figure 8:
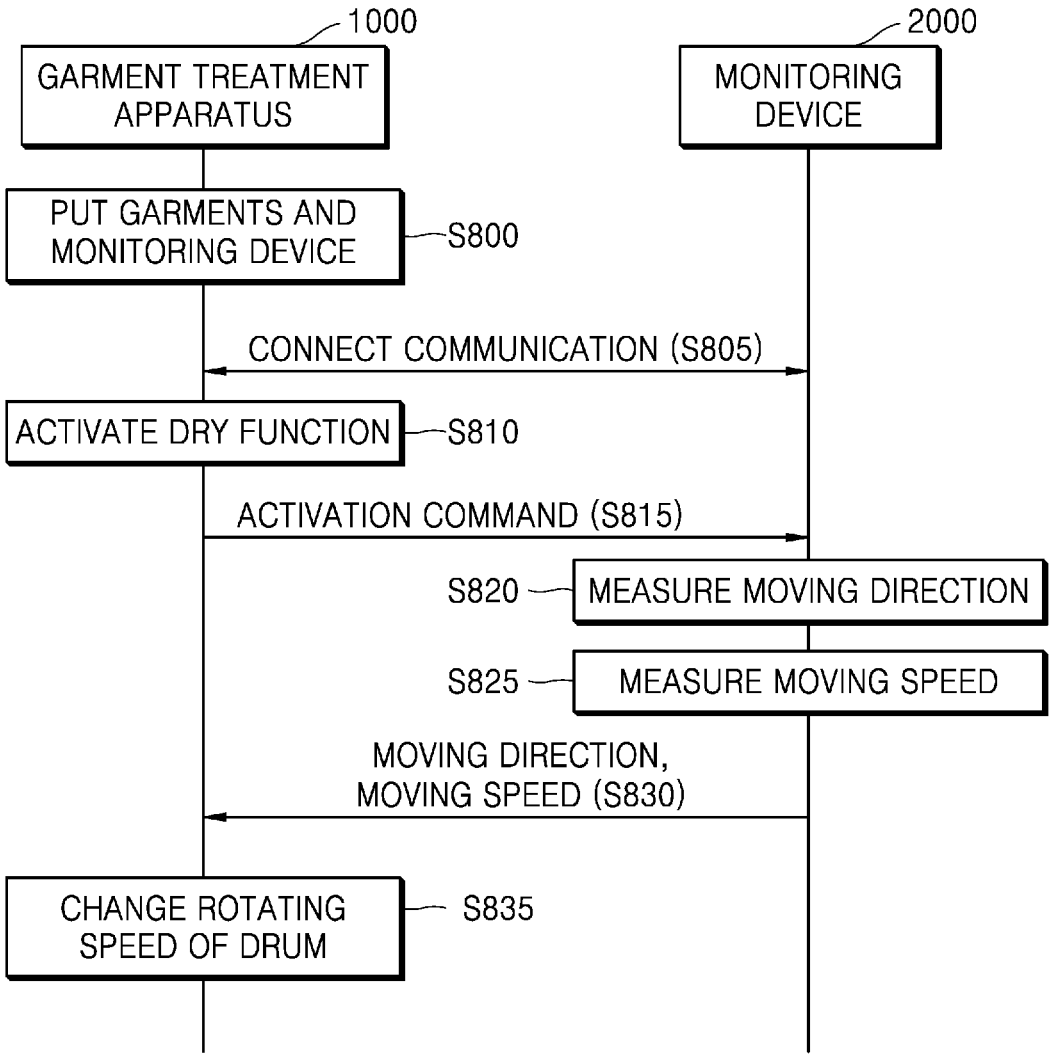
FIG. 8 is a signaling diagram of a method, performed by the garment treatment apparatus, of changing a rotating speed of a drum of the garment treatment apparatus based on a moving direction and a moving speed of the monitoring device, according to an embodiment of the disclosure.

FIG. 8 is a signaling diagram a method, performed by the garment treatment apparatus 1000, of changing a rotating speed of the drum 1030 of the garment treatment apparatus 1000 based on a roving direction and a moving speed of the monitoring device 2000, according to an embodiment of the disclosure.

In operation S800, garments and the monitoring device 2000 may be placed inside the drum 1030. The garments and the monitoring device 2000 may be placed inside the drum 1030 by a user before the garment treatment apparatus 1000 executes an operation for garment treatment.

In operation S805, the garment treatment apparatus 1000 may be connected, via communication, to the monitoring device 2000. When power is applied to the garment treatment apparatus 1000, the garment treatment apparatus 1000 may be connected, via communication, to the monitoring device 2000. Alternatively, when the garment treatment apparatus 1000 receives a Users input for garment treatment, the garment treatment apparatus 1000 may be connected, via communication, to the monitoring device 2000. The garment treatment apparatus 1000 may be connected, via communication, to the monitoring device 2000 through, for example, Bluetooth communication or Wi-Fi communication.

In operation S810, the garment treatment apparatus 1000 may activate the dry function. Upon receiving the user's input for executing the dry function, the garment treatment apparatus 1000 may activate the dry function of drying the garments inside the drum 1030.

In operation S815, the garment treatment apparatus 1000 may transmit an activation command to the monitoring device 2000. The garment treatment apparatus 1000 may transmit, to the monitoring device 2000, a signal indicating initiation of a monitoring operation of the monitoring device 2000. The monitoring device 2000 may activate a function of monitoring a state of the inside of the drum 1030 in response to the activation command of the garment treatment apparatus 1000.

In operation S820 the monitoring device 2000 may measure a moving direction of the monitoring device 2000. When the drum 1030 of the garment treatment apparatus 1000 rotates in the clockwise or counterclockwise direction, the monitoring device 2000 may rotate in the clockwise or counterclockwise direction together with the garments. In addition, the monitoring device 2000 may monitor movement of the monitoring device 2000 by using a sensor and acquire sensing data about the moving direction of the monitoring device 2000. The monitoring device 2000 may acquire the sensing data about the moving direction of the monitoring device 2000 by using, for example a motion sensor and a gyro sensor.

The monitoring device 2000 may generate movement information associated with, for example, whether the monitoring device 2000 moves in the clockwise or counterclockwise direction but is not limited thereto. The monitoring device 2000 may periodically measure a moving direction of the monitoring device 2000 in a certain period. The monitoring device 2000 may measure moving directions of the monitoring device 2000 for a certain time range.

In operation S825, the monitoring device 2000 may measure a moving speed of the monitoring device 2000. In addition, the monitoring device 2000 may monitor movement of the monitoring device 2000 by using a sensor and acquire sensing data about the moving speed of the monitoring device 2000. The monitoring device 2000 may acquire the sensing data about the moving speed of the monitoring device 2000 by using, for example, the motion sensor and the gyro sensor. The monitoring device 2000 may periodically measure a moving speed of the monitoring device 2000 in a certain period. The monitoring device 2000 may measure moving speeds of the monitoring device 2000 for a certain time range.

In operation S830, the monitoring device 2000 may transmit information about the moving direction and the moving speed to the garment treatment apparatus 1000. The monitoring device 2000 may transmit real-time sensing data about a moving direction and a moving speed to the garment treatment apparatus 1000.

In operation S835, the monitoring device 2000 may change a rotating speed of the drum 1030. When the dry function starts, the garment treatment apparatus 1000 may estimate an amount of the garments inside the drum 1030 and determine a rotating speed and a rotating direction of the drum 1030 based on the estimated amount of the garments. In addition, the garment treatment apparatus 1000 may estimate a moving speed and a moving direction of the garments according to the rotating speed and the rotating direction of the drum 1030. In addition, in the middle of the rotation of the drum 1030, the garment treatment apparatus 1000 may change at least one of the rotating speed or the rotating direction of the drum 1030 based on the moving direction and the moving speed received from the monitoring device 2000.

When the moving speed of the monitoring device 2000 differs from the estimated moving speed of the garments, the garment treatment apparatus 1000 may change the rotating speed of the drum 1030. For example, when the moving speed of the monitoring device 2000 is less than the estimated moving speed of the garments, the garment treatment apparatus 1000 may increase the rotating speed of the drum 1030. For example, when the moving speed of the monitoring device 2000 is greater than the estimated moving speed of the garments, the garment treatment apparatus 1000 may decrease the rotating speed of the drum 1030. In addition, when the moving direction of the monitoring device 2000 differs from the estimated moving direction of the garments, the garment treatment apparatus 1000 may change the rotating direction of the drum 1030.

Figure 9:
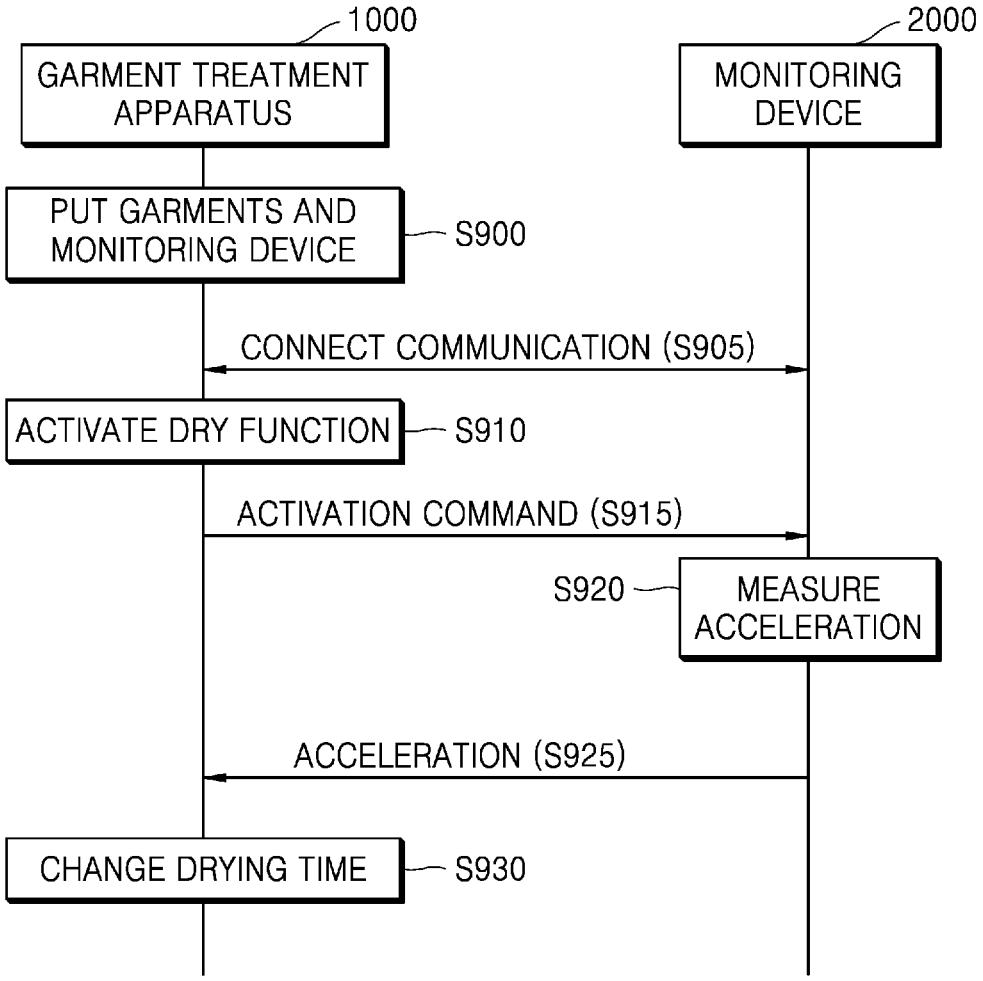
FIG. 9 is a signaling diagram of a method, performed by the garment treatment apparat is, of changing a drying time of the garment treatment apparatus based on an acceleration of the monitoring device, according to an embodiment of the disclosure.

FIG. 9 is a signaling diagram of a method, performed by the garment treatment apparatus 1000, of changing a drying time of the garment treatment apparatus 1000 based on an acceleration of the monitoring device 2000, according to an embodiment of the disclosure.

Operations S900 to S915 correspond to operations S800 to S815, and thus, a description of operations S900 to S915 is omitted for convenience of description.

In operation S920, the monitoring device 2000 may measure an acceleration of the monitoring device 2000. When the drum 1030 of the garment treatment apparatus 1000 rotates in the clockwise or counterclockwise direction the monitoring device 2000 may rotate in the clockwise or counterclockwise direction together with the garments. The monitoring device 2000 may drop from a high position to a low position inside the drum 1030 while moving inside the drum 1030 in the clockwise or counterclockwise direction. While the monitoring device 2000 is dropping from a high position to a low position inside the drum 1030, a speed of the monitoring device 2000 may change, and accordingly, the monitoring device 2000 may measure an acceleration of the monitoring device 2000.

The monitoring device 2000 may measure an acceleration of the monitoring device 2000 by using an acceleration sensor and acquire sensing data indicating the acceleration of the monitoring device 2000. The monitoring device 2000 may periodically measure an acceleration of the monitoring device 2000 in a certain period. The monitoring device 2000 may measure accelerations of the monitoring device 2000 for a certain time range.

In operation S925, the monitoring device 2000 may transmit information about the acceleration to the garment treatment apparatus 1000. The monitoring device 2000 may transmit real-time sensing data about an acceleration of the monitoring device 2000 to the garment treatment apparatus 1000.

In operation S930, the garment treatment apparatus 1000 may change a drying time. The garment treatment apparatus 1000 may estimate an amount of garments inside the drum 1030 at the beginning of the dry function and determine a drying time for which a drying operation is executed, based on the estimated amount of the garments. In addition, the garment treatment apparatus 1000 may estimate an acceleration of the garments according to the estimated amount of the garments and a rotating direction of the drum 1030. The garments may drop from a high position to a low position inside the drum 1030 while moving inside the drum 1030 in the clockwise or counterclockwise direction. While the garments is dropping from a high position to a low position inside the drum 1030, an acceleration of the garments is generated, and the garment treatment apparatus 1000 may estimate the acceleration of the garments based on the estimated amount of the garments, a capacity of the drum 1030, and the rotating direction of the drum 1030.

In addition, in the middle of the rotation of the drum 1030, the garment treatment apparatus 1000 may change a drying time of the garment treatment apparatus 1000 based on the acceleration of the monitoring device 2000, which is received from the monitoring device 200. When the acceleration of the monitoring device 2000 differs from the estimated acceleration of the garments, the garment treatment apparatus 1000 may change the drying time. For example, when the acceleration of the monitor ng device 2000 is less than the estimated acceleration of the garments, because the estimated amount of the garments is less than an actual amount of garments placed inside the drum 1030, the garment treatment apparatus 1000 may increase the drying time. For example, when the acceleration of the monitoring device 2000 is greater than the estimated acceleration of the garments, because the estimated amount of the garments is greater than the actual amount of the garments placed inside the drum 1030, the garment treatment apparatus 1000 may decrease the drying time.

Figure 10:
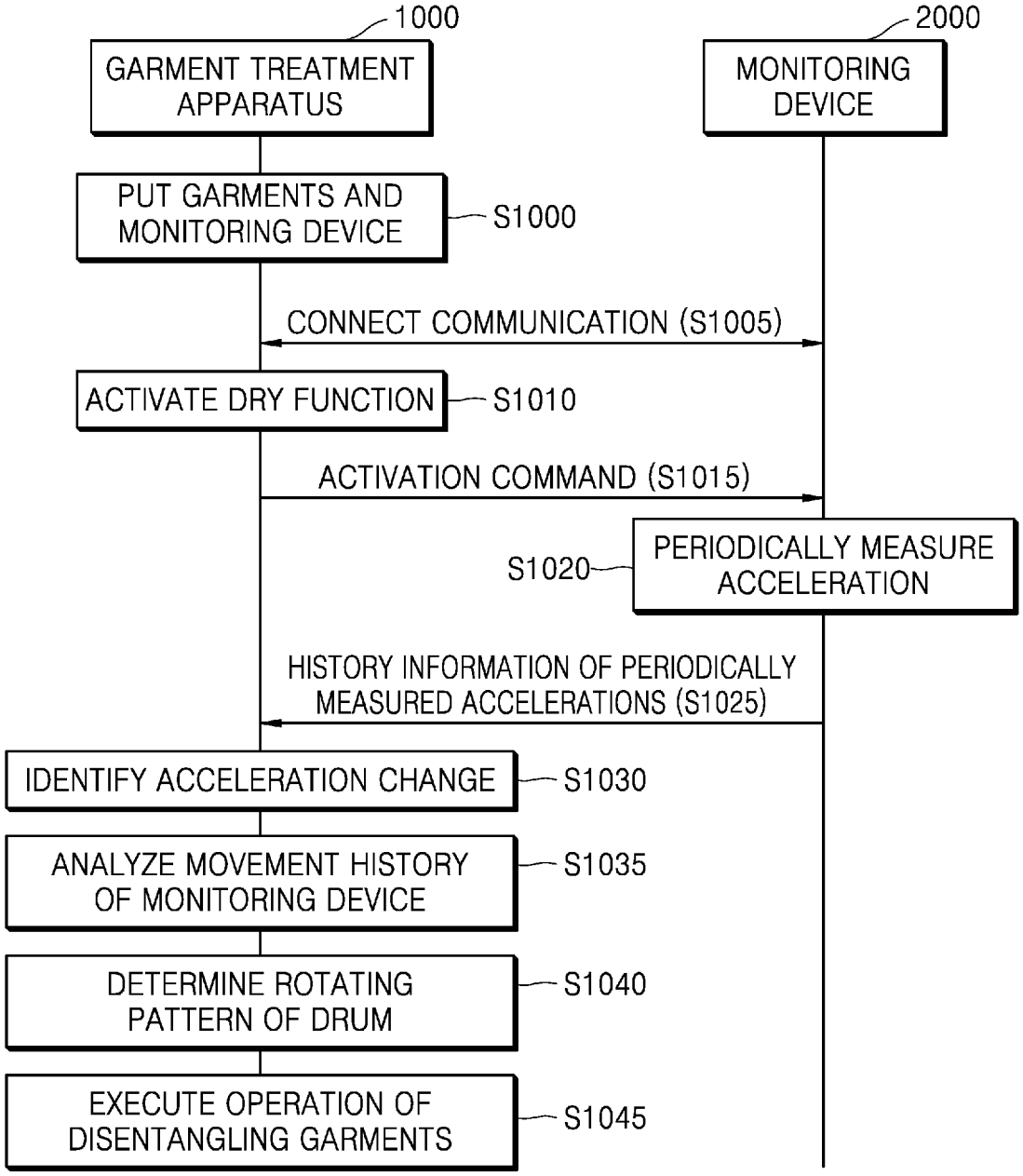
FIG. 10 is a signaling diagram of a method, performed by the garment treatment apparatus, of disentangling garments in the garment treatment apparatus based on an acceleration change of the monitoring device, according to an embodiment of the disclosure.

FIG. 10 is a signaling diagram of a method, performed by the garment treatment apparatus 1000, of disentangling garments in the garment treatment apparatus 1000 based on an acceleration change of the monitoring device 2000, according to an embodiment of the disclosure.

Operations S1000 to S1015 correspond to operations S800 to S815, and thus, a description of operations S1000 to S1015 is omitted for convenience of description.

In operation S1020, the monitoring device 2000 away periodically measure an acceleration of the monitoring device 2000. The monitoring device 2000 may periodically measure an acceleration of the monitoring device 2000 by using an acceleration sensor and periodically acquire sensing data indicating the acceleration of the monitoring device 2000. The monitoring device 2000 may acquire history information about changes in an acceleration of the monitoring device 2000.

In operation S1025, the monitoring device 2000 may transmit history information of periodically measured accelerations to the garment treatment apparatus 1000. The monitoring device 2000 may transmit a plurality of pieces of real-time sensing data about accelerations of the monitoring device 2000 to the garment treatment apparatus 1000.

In operation S1030, the garment treatment apparatus 1000 may identify an acceleration change of the monitoring device 2000. The garment treatment apparatus 1000 may cumulatively store acceleration data of the monitoring device 2000, which is received from the monitoring device 2000, and compare the cumulatively stored acceleration data. For example, when the accelerations of the monitoring device 2000 have gradually decreased, the garment treatment apparatus 1000 may determine to at garments inside the drum 1030 has been entangled. In addition, when the accelerations of the monitoring device 2000 have gradually increased, the garment treatment apparatus 1000 may determine that entangled garments inside the drum 1030 has been disentangled.

In operation S1035, the garment treatment apparatus 1000 may analyze a movement history of the monitoring device 2000. The garment treatment apparatus 1000 may receive real-time information about a moving direction, and a moving speed of the monitoring device 2000. The garment treatment apparatus 1000 may analyze a movement history about how the monitoring device 2000 has moved while the garment treatment apparatus 1000 has been executing the dry function, based on a history of moving directions and moving speeds of the monitoring device 2000.

In operation S1040, the garment treatment apparatus 1000 may determine a rotating pattern of the drum 1030. The garment treatment, apparatus 1000 may estimate how the garments inside the drum 1030 have been entangled, based on history information about the moving directions and the moving speeds of the monitoring device 2000. For example, the garment treatment apparatus 1000 may estimate the garments inside the drum 1030 have been entangled, based on a movement history of the monitoring device 2000, a rotating pattern of the drum 1030 while performing the dry function, and an amount of the garments inside the drum 1030.

In addition, the garment treatment apparatus 1000 may determine a rotating pattern of the drum 1030 to disentangle entangled garments inside the drum 1030, based on the history information about the moving directions and the moving speeds of the monitoring device 2000. For example, the garment treatment apparatus 1000 may determine the rotating pattern of the drum 1030 to disentangle entangled garments inside the drum 1030, based on the movement history of the monitoring device 2000, the rotating pattern of the drum 1030 while performing the dry function, the amount of the garments inside the drum 1030 and a type of the garments inside the drum 1030.

In this case, the garment treatment apparatus 1000 may determine a rotating pattern of the drum 1030 by using a certain learning model for determining the rotating pattern of the drum 1030 to disentangle the entangled garments. The certain learning model for determining the rotating pattern of the drum 1030 to disentangle the entangled garments may be a learning model trained using an artificial intelligence algorithm that is at least one of, for example, a machine learning algorithm, a neural network algorithm, a genetic algorithm, a deep learning algorithm, or a classification algorithm. In addition, for example, the garment treatment apparatus 1000 may acquire a rotating pattern output from the learning model by inputting, into the learning model, data about the movement history of the monitoring device 2000, the rotating pattern of the drum 1030 while performing the dry function, the amount of the garments inside the drum 1030, and the type of the garments inside the drum 1030.

In operation S1045, the garment treatment apparatus 1000 may execute an operation for disentangling the garments. The garment treatment apparatus 1000 may control rotation of the drum 1030 in the garment treatment apparatus 1000 according to the rotating pattern of the drum 1030, which is acquired in operation S1040. The garment treatment apparatus 1000 may receive real-time information about an acceleration of the monitoring device 2000 frown the monitoring device 2000 while controlling rotation of the drum 1030 according to the rotating pattern of the drum 1030, which is acquired in operation S1040. In addition, the garment treatment apparatus 1000 may monitor whether the garments inside the drum 1030 has been disentangled, based on the received real-time acceleration information. When the garments are not disentangled for a certain time, the garment treatment apparatus 1000 may change the rotating pattern of the drum 1030.

Although FIGS. 8 to 10 show examples of operations of the garment treatment apparatus 1000 interworking the monitoring device 2000 when the garment treatment apparatus 1000 executes the dry function, the embodiments are not limited thereto. For example, even when the garment treatment apparatus 1000 executes a garment treatment operation such as a washing function or a rinsing function, the operations of FIGS. 8 to 10 may be applied.

When the garment treatment apparatus 1000 executes the washing function and the rinsing function, the monitoring device 2000 may measure a concentration of a detergent by using a sensor and transmit the measured concentration of the detergent to the garment treatment apparatus 1000. The garment treatment apparatus 1000 may control a function of treating garments based on the concentration received from the monitoring device 2000. For example, the garment treatment apparatus 1000 may adjust a washing time, a washing strength, and a rinsing time. When the garment treatment apparatus 1000 executes the rinsing function and a dehydrating function, the monitoring device 2000 may detect a residual amount of the detergent on the garments by using a detergent detection sensor. When a numeric value of the detected residual amount of the detergent exceeds a certain threshold, the garment treatment apparatus 1000 may output an alarm signal for notifying the user that the residual amount of the detergent is great.

When the garment treatment apparatus 1000 executes the dry function, the monitoring device 2000 may detect a residual amount of the detergent on the garments by using a detergent detection sensor including an olfactory sensor and a spectral measurement sensor. When a numeric value of the detected residual amount of the detergent exceeds a certain threshold, the garment treatment apparatus 1000 may output an alarm signal for notifying the user that the residual amount of the detergent is great.

Figure 11:
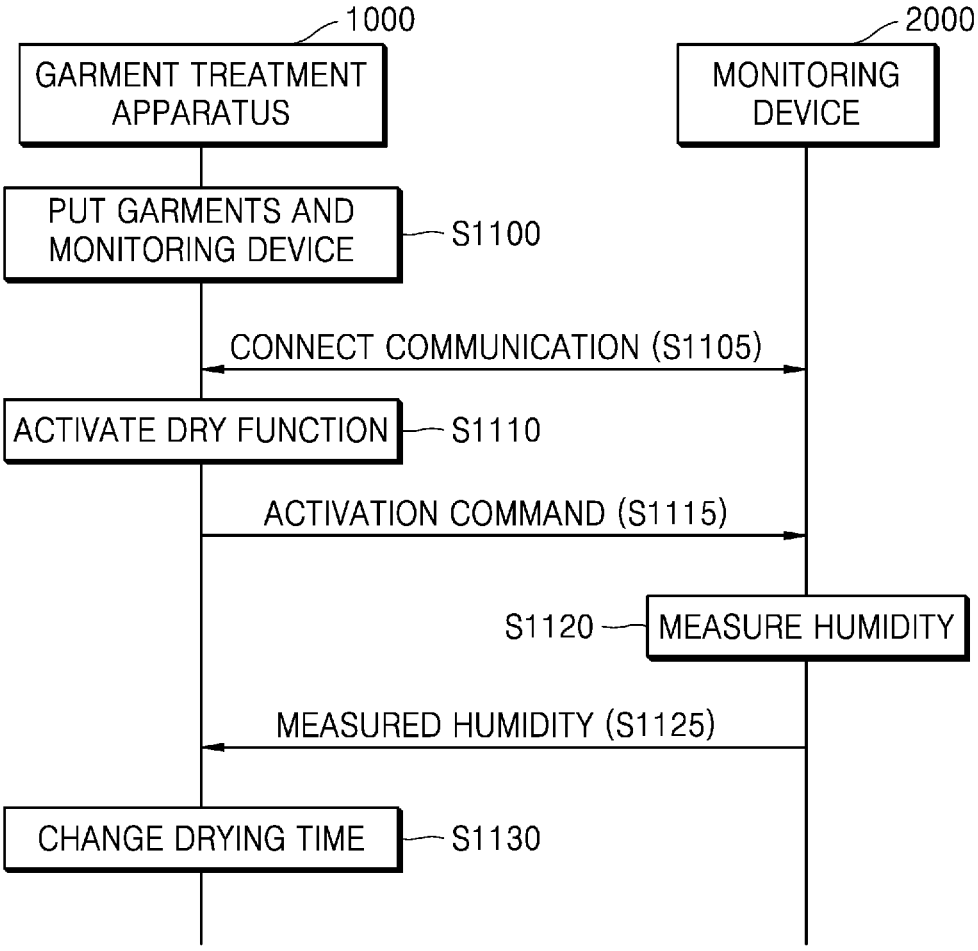
FIG. 11 is a signaling diagram of a method, performed by the garment treatment apparatus, of changing a drying time of the garment treatment apparatus based on ambient humidity of the monitoring device, according to an embodiment of the disclosure.

FIG. 11 is a signaling diagram of a method, performed by the garment treatment apparatus 1000 of changing a drying time of the garment treatment apparatus 1000 based on ambient humidity of the monitoring device 2000, according to an embodiment of the disclosure.

Operations S1100 to S1115 correspond to operations S800 to S815, and thus, a description of operations S1100 to S1115 is omitted for convenience of description.

In operation S1120, the monitoring device 2000 may measure ambient humidity of the monitoring device 2000. The monitoring device 2000 may measure ambient humidity of the monitoring device 2000 by using a humidity sensor and acquire sensing data indicating the ambient humidity of the monitoring, device 2000. The monitoring device 2000 may periodically measure ambient humidity of the monitoring device 2000 in a certain period.

In operation S1125, the monitoring device 2000 may transmit information about the humidity to the garment treatment apparatus 1000. The monitoring device 2000 may transmit real-time sensing data about ambient humidity of the monitoring device 2000 to the garment treatment apparatus 1000.

In operation S1130, the garment treatment apparatus 1000 may change a drying time. The garment treatment apparatus 1000 may change the drying time for which a drying operation is executed, by considering, both humidity measured by a humidity sensor of the garment treatment apparatus 1000 and humidity measured by the monitoring device 2000 in the middle of the execution of the drying operation. Accordingly, the garment treatment apparatus 1000 may adjust the drying time by considering both humidity of an edge part of the drum 1030 and humidity of a central part of the drum 1030 in a space inside the drum 1030.

For example, when the humidity measured by the humidity sensor of the garment treatment apparatus 1000 and the humidity measured by the monitoring device 2000 are less than a certain threshold, the garment treatment apparatus 1000 may reduce the drying time or end the drying operation. For example, when the humidity measured by the humidity sensor of the garment treatment apparatus 1000 is greater than the certain threshold, and the humidity measured by the monitoring device 2000 is less than the certain threshold, the garment treatment apparatus 1000 may increase the drying time. For example, when the humidity measured by the humidity sensor of the garment treatment apparatus 1000 is less than the certain threshold, and the humidity measured by the monitoring device 2000 is greater than the certain threshold, the garment treatment apparatus 1000 may decrease the drying time.

Figure 12:
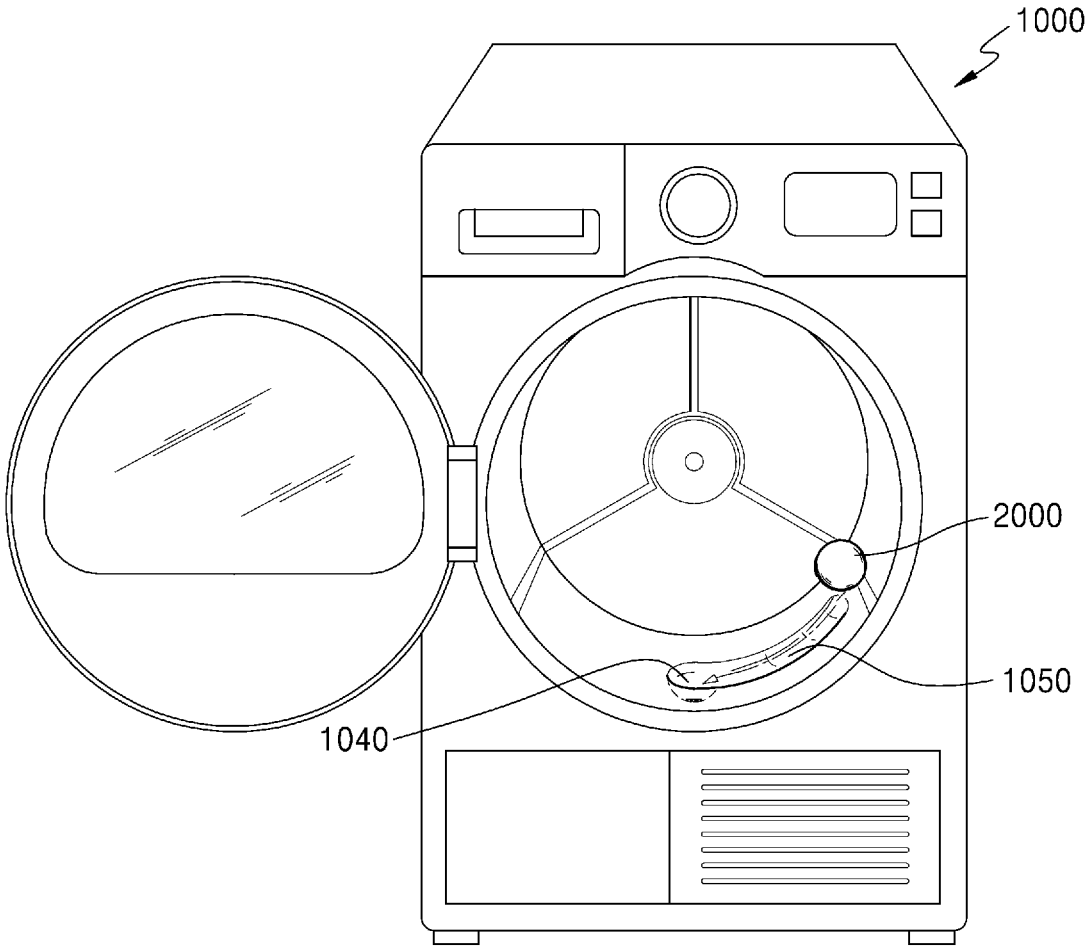
FIG. 12 illustrates an example in which the garment treatment apparatus charges the monitoring device, according to an embodiment of the disclosure.

FIG. 12 illustrates an example in which the garment treatment apparatus 1000 charges the monitoring device 2000, according to an embodiment of the disclosure.

Referring to FIG. 12, the drum 1030 may include a charging groove 1040 and a guide part 1050. The charging groove 1040 may provide a function of fixing the monitoring device 2000 and charging the monitoring device 2000.

The guide part 1050 may provide a function of guiding the monitoring device 2000 such that the monitoring device 2000 may move to the inside of the charging groove 1040.

After a garment treatment operation of the garment treatment apparatus 1000 ends and the user takes garments inside the drum 1030 out of the drum 1030, the garment treatment apparatus 1000 may slowly rotate the drum 1030. Accordingly, the monitoring device 2000 may move to the inside of the charging groove 1040 by rolling along the guide part 1050. When the monitoring device 2000 is located inside the charging groove 1040, the garment treatment apparatus 1000 may activate a function of charging a battery of the monitoring device 2000.

Figure 13:
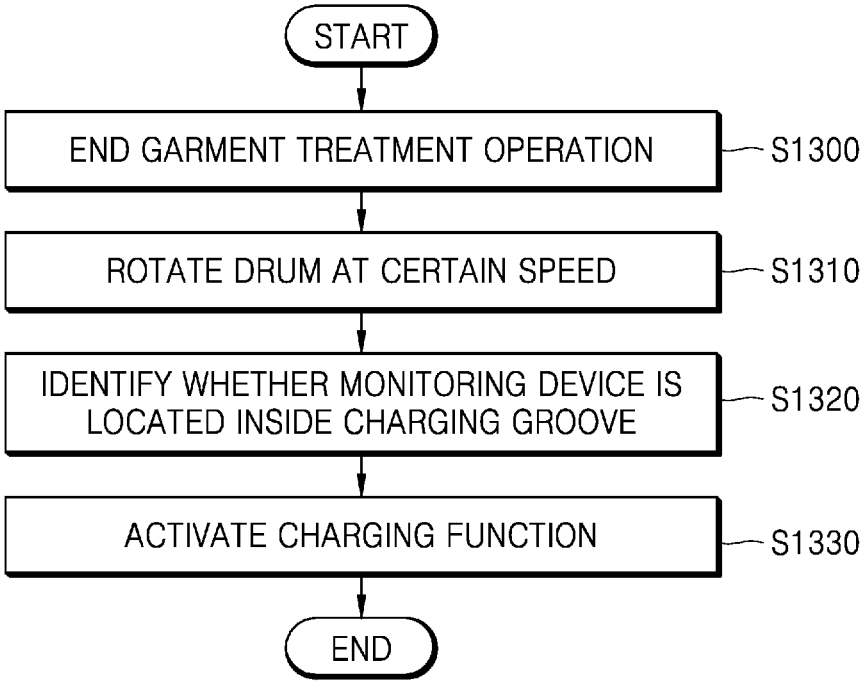
FIG. 13 is a flowchart of a method, performed by the garment treatment apparatus, of charging the monitoring device, according to an embodiment of the disclosure.

FIG. 13 is a flowchart of a method, performed by the garment treatment apparatus 1000, of charging the monitoring device 2000, according to an embodiment of the disclosure.

In operation S1300, the garment treatment apparatus 1000 may end a garment treatment operation. The garment treatment apparatus 1000 may end the garment treatment operation after completing garment treatment. After the garment treatment operation ends, the user may take garments inside the drum 1030 out of the garment treatment apparatus 1000.

In operation S1310, the garment treatment apparatus 1000 may rotate the drum 1030 at a certain speed. The garment treatment apparatus 1000 may sense that the garments inside the drum 1030 have disappeared, and slowly rotate the drum 1030 of the garment treatment apparatus 1000 at the certain speed or less. Alternatively, the garment treatment apparatus 1000 may slowly rotate the drum 1030 of the garment treatment apparatus 1000 at the certain speed or less based on the users input. Accordingly, the monitor ng device 2000 may roll along an inner circumferential surface of the drum 1030 and seat inside the charging groove 1040 by passing through the guide part 1050.

In operation S1320, the garment treatment apparatus 1000 may identify whether the monitoring device 2000 is located inside the charging groove 1040. The garment treatment apparatus 1000 may identify whether the monitoring device 2000 is located inside the charging groove 1040 when the monitoring device 2000 is located inside the charging groove 1040.

In operation S1330, the garment treatment apparatus 1000 may activate a charging function. The garment treatment apparatus 1000 may charge a battery inside the monitoring device 2000 by activating a wireless charging function. Alternatively, the garment treatment apparatus 1000 may charge the battery inside the monitoring device 2000 by activating a wired charging function. When a charging terminal (not shown) provided to the monitoring device 2000 comes in contact with a charging terminal (not shown) inside the charging groove 1040, the garment treatment apparatus 1000 may charge the monitoring device 2000 in a wired manner.

An embodiment of the disclosure may be implemented in a form of a recording medium including computer-executable instructions such as a program module executed by a computer system. A computer-readable medium may be an arbitrary available medium which may be accessed by a computer system and includes all types of volatile and non-volatile media and separated and non-separated media. In addition, the computer-readable medium may include all types of computer storage media and communication media. The computer storage media include all types of volatile and non-volatile and separated and non-separated media implemented by an arbitrary method or technique for storing information such as computer-readable instructions, a data structure, a program module, or other data.

The communication media typically include computer-readable instructions, a data structure, a program module, other data of a modulated signal.

In addition, in the present specification, "unit, interface, or -er (or)" may indicate a hardware component such as a processor or a circuit and/or a software component executed by a hardware component such as a processor.

The embodiments of the disclosure described above are only illustrative, and it will be understood by those of ordinary skill in the art that various changes in form and details may be made therein without changing the technical spirit and mandatory features of the disclosure. Therefore, the embodiments of the disclosure should be understood in the illustrative sense only and not for the purpose of limitation in all aspects. For example, each component described as a single type may be carried out by being distributed, and likewise, components described as a distributed type may also be carried out by being coupled.

While one or more embodiments of the disclosure have been described with reference to the figures, it will be understood by those of ordinary skill in the art that various changes in form and details may be made therein without departing from the spirit and scope as defined by the following claims.

What is claimed is:

1. A method, performed by a garment treatment apparatus, of controlling an operation of the garment treatment apparatus, the method comprising:

establishing wireless communication with a monitoring device placed inside a drum of the garment treatment apparatus;

rotating the drum to treat garments;

receiving movement information associated with movement of the monitoring device from the monitoring device during the rotating of the drum;

controlling the rotating of the drum based on the movement information received;

rotating the drum at a certain speed after ending treatment of the garments;

identifying whether the monitoring device is located inside a charging groove in the drum; and activating a function of charging the monitoring device when the monitoring device is identified as being located inside the charging groove, wherein the monitoring device moves in the drum, that is rotating, together with the garments in the garment treatment apparatus.

2. The method of claim 1, wherein the receiving of the movement information comprises receiving information about a moving speed of the monitoring device, and the controlling of the rotating of the drum comprises controlling a rotating speed of the drum based on the moving speed of the monitoring device.

3. The method of claim 2, wherein the receiving of the movement information comprises receiving information about a moving direction of the monitoring device, and the controlling of the rotating of the drum comprises controlling the rotating speed of the drum based on the moving speed and the moving direction of the monitoring device.

4. The method of claim 1, wherein the receiving of the movement information comprises receiving information about an acceleration of the monitoring device, and the method further comprises changing an operating time of the garment treatment apparatus based on the acceleration of the monitoring device.

5. The method of claim 4, wherein the receiving of the movement information comprises periodically receiving information about the acceleration of the monitoring device, and the method further comprises executing a function of disentangling the garments, based on a change history of the acceleration of the monitoring device.

6. The method of claim 5, further comprising determining a rotating pattern of the drum to disentangle the garments, based on a movement history of the monitoring device, wherein the executing of the function of disentangling the garments comprises controlling rotation of the drum based on the rotating pattern of the drum that is determined.

7. The method of claim 1, further comprising:

receiving humidity information about ambient humidity of the monitoring device from the monitoring device; and changing an operating time of the garment treatment apparatus based on the humidity information received.

8. The method of claim 1, wherein the monitoring device moves to the charging groove by a guide part formed along an inner circumferential surface of the drum rotating at the certain speed.

9. The method of claim 1, wherein the garment treatment apparatus comprises at least one of a washer or a dryer.

10. A garment treatment apparatus configured to communicate with a monitoring device, the garment treatment apparatus comprising:

a communication interface configured to wirelessly communicate with the monitoring device;

a drum configured to accommodate garments and the monitoring device therein;

a memory storing one or more instructions; and a controller configured to execute the one or more instructions stored in the memory, wherein the controller is further configured, by executing the one or more instructions, to:

establish wireless communication with the monitoring device put into the drum, rotate the drum to treat the garments, receive movement information associated with movement of the monitoring device from the monitoring device during the rotating of the drum, control the rotating of the drum based on the movement information received, rotate the drum at a certain speed after ending treatment of the garments, identify whether the monitoring device is located inside a charging groove in the drum, and activate a function of charging the monitoring device when the monitoring device is identified as being located inside the charging groove, wherein, in a case where the drum is rotating, the monitoring device moves in the drum together with the garments in the garment treatment apparatus.

11. The garment treatment apparatus of claim 10, wherein the controller is further configured, by executing the one or more instructions, to:

receive information about a moving speed of the monitoring device, and control a rotating speed of the drum based on the moving speed of the monitoring device.

12. The garment treatment apparatus of claim 11, wherein the controller is further configured, by executing the one or more instructions, to:

receive information about a moving direction of the monitoring device, wherein the controller is configured to control the rotating speed of the drum based on the moving speed and the moving direction of the monitoring device.

13. The garment treatment apparatus of claim 10, wherein the controller is further configured, by executing the one or more instructions, to:

receive information about an acceleration of the monitoring device, and change an operating time of the garment treatment apparatus based on the acceleration of the monitoring device.

14. The garment treatment apparatus of claim 13, wherein the controller is further configured, by executing the one or more instructions, to:

periodically receive information about the acceleration of the monitoring device, and execute a function of disentangling the garments, based on a change history of the acceleration of the monitoring device.

15. The garment treatment apparatus of claim 14, wherein the controller is further configured, by executing the one or more instructions, to:

determine a rotating pattern of the drum to disentangle the garments, based on a movement history of the monitoring device, and control rotation of the drum based on the rotating pattern of the drum that is determined.

16. The garment treatment apparatus of claim 10, wherein the controller is further configured, by executing the one or more instructions, to:

receive humidity information about ambient humidity of the monitoring device from the monitoring device, and change an operating time of the garment treatment apparatus based on the humidity information received.

17. The garment treatment apparatus of claim 10, wherein the drum further comprises a guide part formed along an inner circumferential surface of the drum, and the monitoring device moves to the charging groove by the guide part of the drum in a case where the drum is rotating at the certain speed.

18. A system comprising:

the garment treatment apparatus according to claim 10; and the monitoring device, wherein the monitoring device comprises:

a communication interface configured to wirelessly communicate with the garment treatment apparatus;

a sensor;

a memory storing one or more instructions; and a processor configured to execute the one or more instructions stored in the memory of the monitoring device, wherein the processor of the monitoring device is further configured, by executing the one or more instructions stored in the memory of the monitoring device, to:

establish wireless communication with the garment treatment apparatus, sense the movement of the monitoring device, caused by rotation of the drum of the garment treatment apparatus, during the rotation of the drum, and provide the movement information associated with the movement of the monitoring device to the garment treatment apparatus.

* * * * *